US008302521B2

(12) United States Patent
Liu et al.

(10) Patent No.: US 8,302,521 B2
(45) Date of Patent: Nov. 6, 2012

(54) DIE WITH A PUNCH MODULE

(75) Inventors: Jian-Rui Liu, Shenzhen (CN); Yong Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 291 days.

(21) Appl. No.: 12/817,190

(22) Filed: Jun. 17, 2010

(65) Prior Publication Data

US 2011/0232451 A1 Sep. 29, 2011

(30) Foreign Application Priority Data

Mar. 25, 2010 (CN) ..... 2010 1 0132631

(51) Int. Cl.
*B21D 28/04* (2006.01)
*B21D 28/34* (2006.01)

(52) U.S. Cl. ..... 83/684; 83/698.91

(58) Field of Classification Search ..... 83/684, 83/685, 686, 698.91
See application file for complete search history.

(56) References Cited

U.S. PATENT DOCUMENTS 3,548,700 A * 12/1970 Herzog et al. ..... 83/698.91
5,934,165 A * 8/1999 Chatham ..... 83/588
6,463,839 B2 * 10/2002 Ohtsuka et al. ..... 83/698.91
7,159,426 B1 * 1/2007 Ghiran ..... 72/55

* cited by examiner

*Primary Examiner* — Kenneth E. Peterson
*Assistant Examiner* — Jennifer Swinney
(74) *Attorney, Agent, or Firm* — Altis Law Group, Inc.

(57) ABSTRACT

A punch module includes a fixing plate, a clamping member, an engaging member, a number of latching members, and a punch. The fixing plate defines an assembly space. The clamping member detachably fixed to the fixing plate and received in the assembly space of the fixing plate defines a first receiving space. The engaging member received in the first receiving space of the clamping member defines a second receiving space. The latching members are movably received in the first receiving space of the clamping member and the second receiving space of the engaging member. The punch extends through the clamping member, the engaging member, and the fixing plate, and defines a latching slot engagable with the latching members.

13 Claims, 6 Drawing Sheets

DIE WITH A PUNCH MODULE

BACKGROUND

1. Technical Field

The present disclosure relates to a die with a punch module.

2. Description of Related Art

Dies require constant maintenance, and most maintenance is related to punches. However, in maintenance, the dies must be completely disassembled to repair or replace the punches, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings in which like references indicate similar elements, is illustrated by way of example and not by way of limitation. It should be noted that references to "an" or "one" embodiment in this disclosure are not necessarily to the same embodiment, and such references mean at least one.

Figure 1:
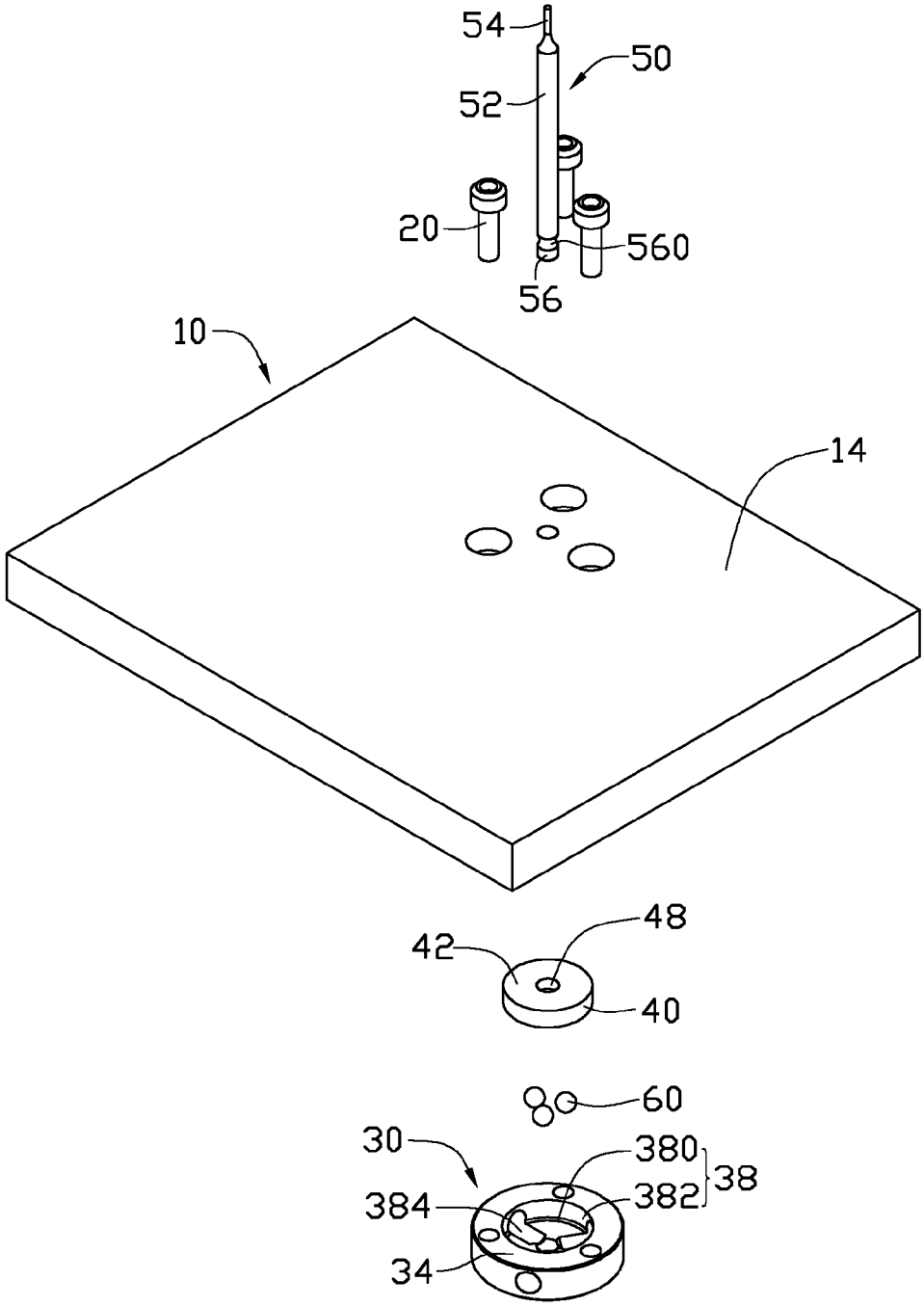
FIG. 1 is an exploded, isometric view of an exemplary embodiment of a punch module.
Figure 2:
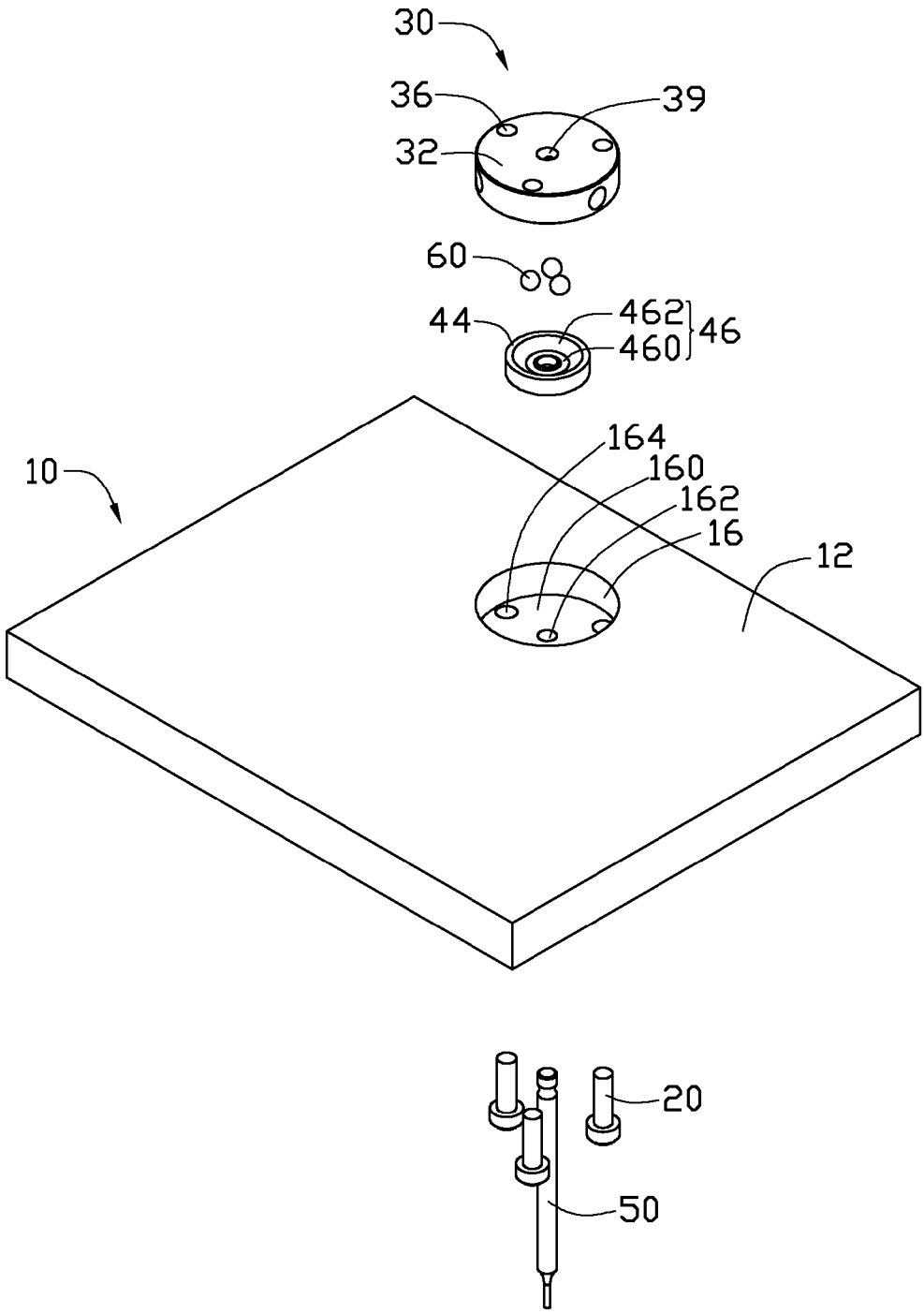
FIG. 2 is an inverted view of the punch module of FIG. 1.
Figure 3:
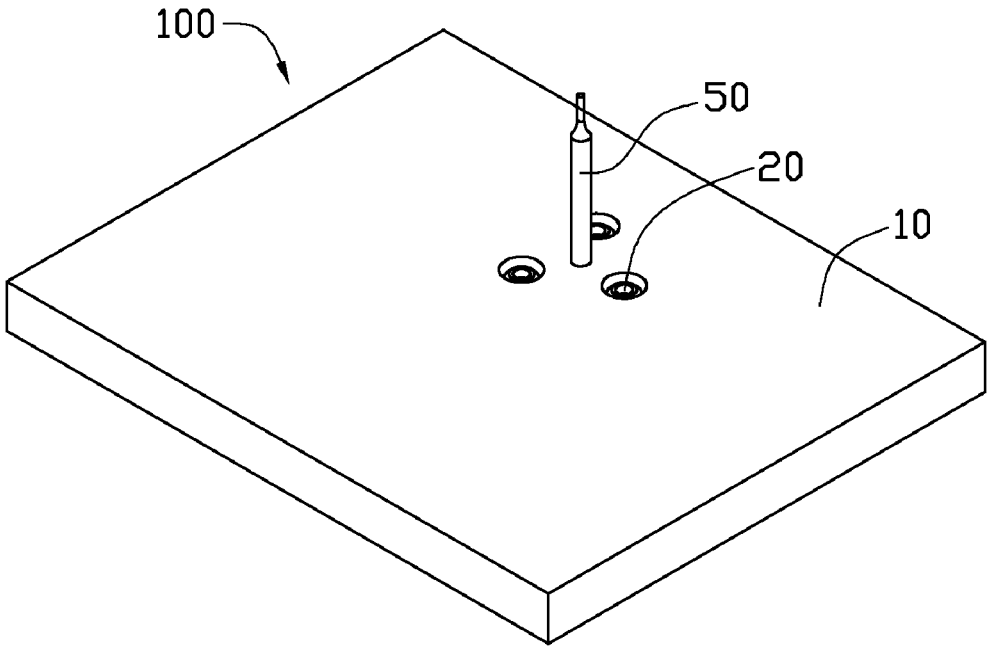
FIG. 3 is an assembled, isometric view of the punch module of FIG. 1.

Referring to FIGS. 1, 2, and 3, an exemplary embodiment of a punch module 100 includes a fixing plate 10, a plurality of fixing members 20, a clamping member 30, an engaging member 40, a punch 50, and a plurality of latching members 60.

The fixing plate 10 includes a first side 12 and a second side 14 opposite to the first side 12. The first side 12 defines a round assembly space 16 with a bottom wall 160. The bottom wall 160 defines a first through hole 162 in a center of the bottom wall 160, and a plurality of second through holes 164 surrounding the first through hole 162. The first and second through holes 162 and 164 extend through the bottom wall 160 and the second side 14. Each second through hole 164 is T-shaped along extending direction, and a greater end of each second through hole 164 is located on the second side 14.

In this embodiment, each fixing member 20 is a screw.

The clamping member 30 received in the assembly space 16 is coin-shaped and includes a first side 32 and a second side 34 opposite to the first side 32. The second side 34 defines a round receiving space 38, and a plurality of screw holes 36 surrounding the receiving space 38 and corresponding to the second through holes 164 of the fixing plate 10. The receiving space 38 includes a bottom wall 380 and a sidewall 382 perpendicular to and bounding the bottom wall 380. The clamping member 30 defines a through hole 39 through the center of the bottom wall 380 and the first side 32. The bottom wall 380 defines a plurality of sliding slots 384 surrounding the through hole 39 and corresponding to the latching members 60. Each sliding slot 384 slantingly extends from the bottom wall 380 to the sidewall 382.

The engaging member 40 received in the receiving space 38 is coin-shaped and includes a first side 42 and a second side 44 opposite to the first side 42. The second side 44 defines a receiving space 46. The receiving space 46 includes a bottom wall 460 and a sidewall 462 bounding the bottom wall 460 and slantingly connected to the bottom wall 460. The engaging member 40 defines a through hole 48 through the center of the first side 42 and the bottom wall 460 and corresponding to the through hole 39 of the clamping member 30.

The punch 50 includes a long cylindrical main body 52, a punching end 54 extending from a first end of the main body 52, and a latch end 56 extending from a second end of the main body 52 opposite to the first end. The latch end 56 defines a annular latching slot 560 in a circumference of the latch end 56.

In this embodiment, each latching member 60 is a globular piece, such as a steel ball.

Figure 4:
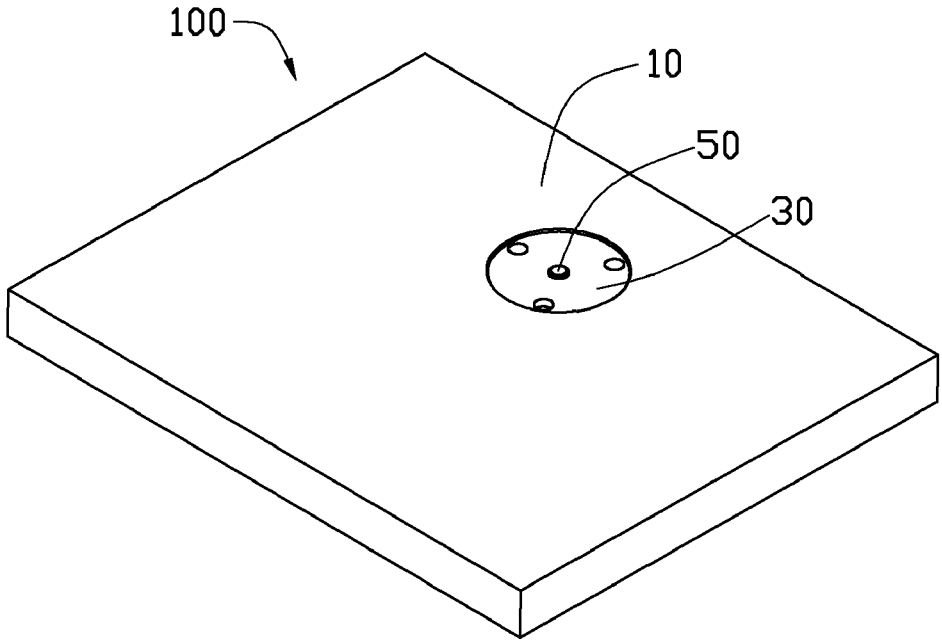
FIG. 4 is an assembled, isometric view of the punch module of FIG. 2.
Figure 6:
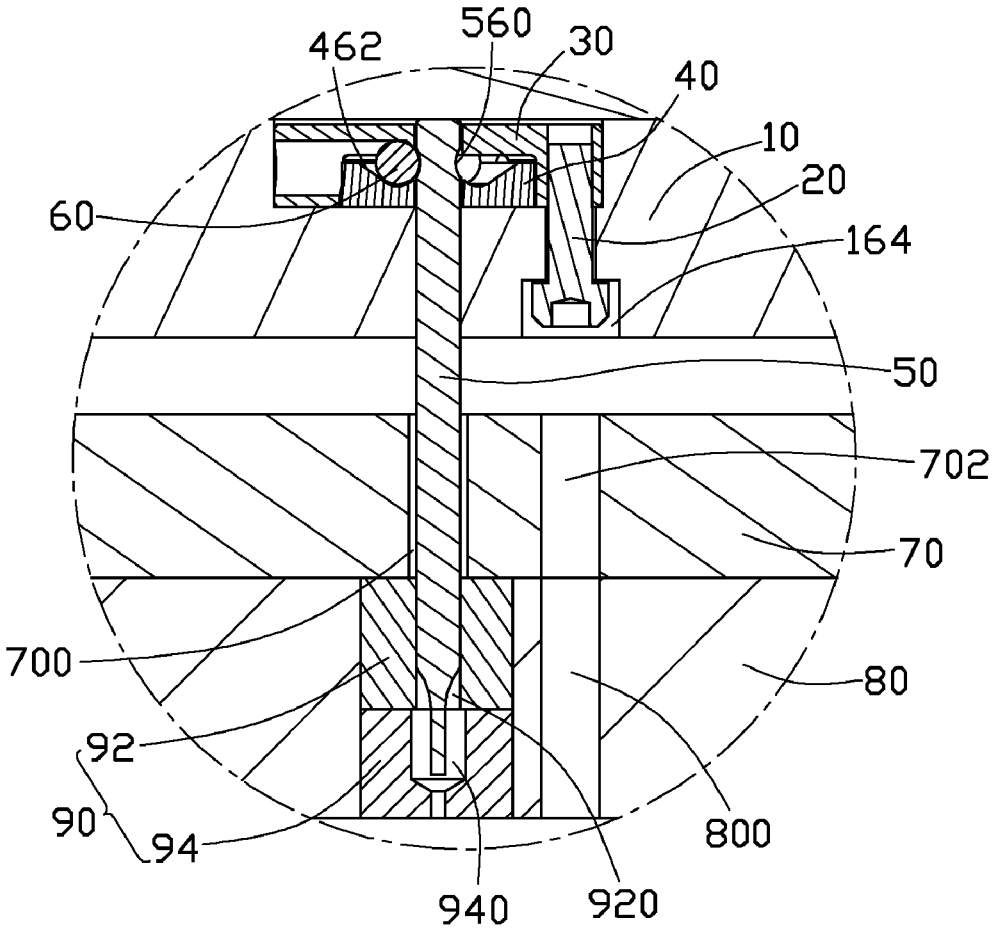
FIG. 6 is an enlarged view of the circled portion V of FIG. 5.

Referring to FIGS. 3, 4, and 6, in assembly, the latching members 60 are placed in corresponding sliding slots 384 of the clamping member 30. The engaging member 40 is received in the receiving space 38 of the clamping member 30, with the second side 44 of the engaging member 40 resisting against the bottom wall 380 of the receiving space 38. The latching members 60 are received in the receiving space 46 and resists against the sidewall 462 of the engaging member 40. The through hole 48 of the engaging member 40 aligns with the through hole 39 of the clamping member 30. The clamping member 30 with the engaging member 40 is received in the assembly space 16 of the fixing plate 10, with the first side 42 of the engaging member 40 resisting against the bottom wall 160 of the assembly space 16. The through hole 48 of the engaging member 40 aligns with the first through hole 162 of the fixing plate 10. Each screw hole 36 of the clamping member 30 aligns with a corresponding second through hole 164 of the fixing plate 10.

Each fixing member 20 extends through a corresponding second through hole 164 of the fixing plate 10 and are screwed into a corresponding screw hole 36 of the clamping member 30. The latch end 56 of the punch 50 extends through the first through hole 162 of the fixing plate 10, the through hole 48 of the engaging member 40, and the through hole 39 of the clamping member 30 in that order, and pushes the latching members 60 to move upwards along the sidewall 462. When the latching slot 560 of the punch 50 is located in the receiving space 46, the latching members 60 slide downward along the sidewall 462 to partly locate in the latching slot 560.

Then, the fixing members 20 are firmly screwed to pull the clamping member 30 for the fixing plate 10. Thereby the bottom wall 380 of the receiving space 38 presses the second side 44 of the engaging member 40, and the bottom wall 160 of the assembly space 16 presses the first side 42 of the engaging member 40 and the sidewall 462 presses the latching members 60, making the latching members 60 approach the center of the receiving space 38 along the sliding slots 384 to mount the punch 50. In disassembly, the fixing members 20 are loosened to pull out the punch 50.

Figure 5:
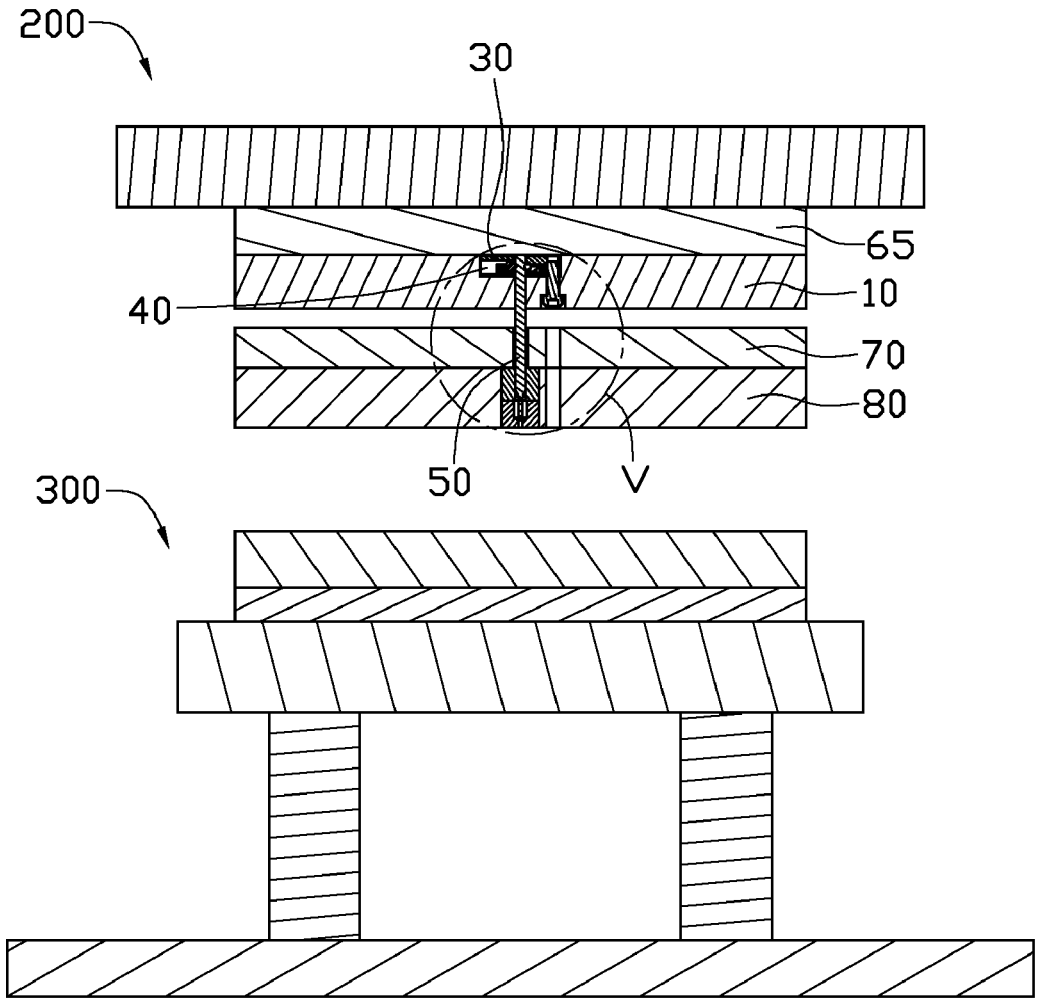
FIG. 5 is a sectional, assembled view of a die having the punch module of FIG. 4.

Referring to FIGS. 5 and 6, a die with the punch module 100 includes an upper mold 200 and a lower mold 300 matching the upper mold 200. The upper mold 200 includes a fixing board 65 mounting the fixing plate 10 and resisting against the first side 12 of the fixing plate 10, an unloading backboard 70 apart from the second side 14 of the fixing plate 10, and an unloading plate 80 mounted to the unloading backboard 70 opposite to the fixing plate 10. An inlay module 90 is inlaid in the unloading plate 80. The inlay module 90 includes a first inlay plate 92 and a second inlay plate 94 below the first inlay plate 92. The first inlay plate 92 and the second inlay plate 94 are mounted to the unloading backboard 70 by screws (not shown), with the first inlay plate 92 resisting against the unloading backboard 70. The unloading backboard 70, the first inlay plate 92, the second inlay plate 94 each correspondingly define a through hole 700, 920, and 940, through which the punch 50 extends.

In assembly, the punch 50 extends the through holes 700, 920, and 940 in that order. The unloading backboard 70 and the unloading plate 80 each correspondingly define a plurality of through holes 702 and 800 corresponding to the second through holes 164 of the fixing plate 10.

In replacing or repairing the punch 50, the inlay module 90 is unscrewed from the unloading backboard 70 and taken out from the unloading plate 80. A wrench (not shown) can then be extended through the through holes 700, 800 and the second through holes 164 to loosen the fixing members 20 to pull out the punch 50.

In other embodiments, the inlay module 90 can be omitted.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A punch module comprising:

a fixing plate defining an assembly space in a first side of the fixing plate, and a bottom wall of the assembly space defining a first through hole through a center of the bottom wall and a second side of the fixing plate opposite to the first side;

a clamping member detachably fixed to the fixing plate and received in the assembly space of the fixing plate, and the clamping member comprising a first side facing the bottom wall of the assembly space and a second side opposite to the first side, the first side of the clamping member defining a first receiving space, a bottom wall of the first receiving space defining a second through hole through a center of the bottom wall of the first receiving space and the second side of the clamping member;

an engaging member received in the first receiving space of the clamping member, with a first side of the engaging member facing the bottom wall of the assembly space and a second side of the engaging member facing the bottom wall of the clamping member, the second side of the engaging member defining a second receiving space, and a bottom wall of the second receiving space defining a third through hole through a center of the bottom wall of the second receiving space and the first side of the engaging member;

a plurality of latching members movably received in the first receiving space of the clamping member and the second receiving space of the engaging member; and a punch comprising an end extending through the second through hole of the clamping member, the third through hole of the engaging member, and the first through hole of the fixing plate, and defining a latching slot engaged with the plurality of latching members.

2. The punch module of claim 1, wherein each latching member is a steel ball.

3. The punch module of claim 2, wherein the clamping member is fixed to the fixing plate via a plurality of screws.

4. The punch module of claim 3, wherein the second receiving space comprises a sidewall bounding the bottom wall and slantingly connected to the bottom wall to resist against the latching members.

5. The punch module of claim 4, wherein the first receiving space comprises a sidewall perpendicular to and bounding the bottom wall, the clamping member defines a plurality of sliding slots, each sliding slot slantingly extends from the bottom wall of the first receiving space to the sidewall.

6. A die comprising:

a lower module; and an upper module matching the lower module, the upper module comprising:

a punch module comprising:

a fixing plate defining an assembly space in a first side of the fixing plate, and a bottom wall of the assembly space defining a first through hole through a center of the bottom wall and a second side of the fixing plate opposite to the first side;

a clamping member detachably fixed to the fixing plate and received in the assembly space of the fixing plate, and the clamping member comprising a first side facing the bottom wall of the assembly space and a second side opposite to the first side, the first side of the clamping member defining a first receiving space, a bottom wall of the first receiving space defining a second through hole through a center of the bottom wall of the first receiving space and the second side of the clamping member;

an engaging member received in the first receiving space of the clamping member, with a first side of the engaging member facing the bottom wall of the assembly space and a second side of the engaging member facing the bottom wall of the clamping member, the second side of the engaging member defining a second receiving space, and a bottom wall of the second receiving space defining a third through hole through a center of the bottom wall of the second receiving space and the first side of the engaging member;

a plurality of latching members movably received in the first receiving space of the clamping member and the second receiving space of the engaging member; and a punch extending through the second through hole of the clamping member, the third through hole of the engaging member, and the first through hole of the fixing plate, and defining a latching slot engaged with the plurality of latching members.

7. The die of claim 6, wherein each latching member is a steel ball.

8. The die of claim 7, wherein the clamping member is fixed to the fixing plate via a plurality of screws.

9. The die of claim 7, further comprising an unloading backboard, and an unloading plate mounted to the unloading backboard, wherein the unloading backboard and the unloading plate each define a plurality of first through holes corresponding to the plurality of screws.

10. The die of claim 9, wherein the unloading backboard defines a fourth through hole for the punch extending through.

11. The die of claim 10, further comprising an inlay module inlaid in the unloading plate, wherein the punch extends through the inlay module.

12. The die of claim 7, wherein the second receiving space comprises a sidewall bounding the bottom wall and slantingly connected to the bottom wall, to resist against the latching members.

13. The die of claim 12, wherein the first receiving space comprises a sidewall perpendicular to and bounding the bottom wall, the clamping member defines a plurality of sliding slots, each sliding slot slantingly extends from the bottom wall of the first receiving space to the sidewall.

* * * * *